US005765354A

United States Patent [19]

Fink et al.

[11] Patent Number: 5,765,354

[45] Date of Patent: Jun. 16, 1998

[54] SPINNING OR TWISTING MACHINE, ESPECIALLY TWO-FOR-ONE TWISTING MACHINE OR DIRECT CABLING MACHINE

[75] Inventors: Heinz Fink, Krefeld; Jürgen Kallmann, Kaarst, both of Germany

[73] Assignee: Palitex Project-Company GmbH, Krefeld, Germany

[21] Appl. No.: 822,130

[22] Filed: Mar. 21, 1997

[30] Foreign Application Priority Data

Mar. 21, 1996 [DE] Germany ..... 196 11 083.1

[51] Int. Cl.[6] ..... D01H 13/00

[52] U.S. Cl. ..... 57/104; 57/58.49; 57/105

[58] Field of Search ..... 57/104, 105, 58.49, 57/1 R

[56] References Cited

U.S. PATENT DOCUMENTS

| | | | |
|---|---|---|---|
| 4,330,987 | 5/1982 | Schippers et al. | 57/104 |
| 4,332,129 | 6/1982 | Schipper et al. | 57/105 |
| 5,551,222 | 9/1996 | Kawarashi | 57/105 |

FOREIGN PATENT DOCUMENTS

| | | | |
|---|---|---|---|
| 2430992 | 2/1980 | France . | |
| 3301811 | 7/1984 | Germany . | |
| 4323023 | 1/1994 | Germany . | |
| 237649 | 6/1971 | U.S.S.R. | 57/105 |

*Primary Examiner*—William Stryjewski
*Attorney, Agent, or Firm*—Robert W. Becker & Associates

[57] ABSTRACT

A textile machine has a machine frame with a first and a second end. Spindles are connected to the machine frame in two parallel rows extending in the longitudinal direction. A first tangential drive belt arrangement for driving the spindles of the first row includes a first tangential drive belt and two first shafts positioned at the first and second ends and having a first pulley connected thereto. The first tangential drive belt extends between the first and second ends and is guided about the first pulleys. A second tangential drive belt arrangement for driving the spindles of the second row includes a second tangential drive belt and two second shafts, positioned at the first and second ends and having a second pulley connected thereto. The second tangential drive belt extends between the first and second ends and is guided about the second pulleys. Two drive motors are positioned at the first and second ends. The first drive motor has a coupling device for engaging the first or second tangential drive belt arrangement. The second drive motor has a coupling device for engaging the first or second tangential drive belt arrangement not engaged by the first drive motor.

2 Claims, 2 Drawing Sheets

SPINNING OR TWISTING MACHINE, ESPECIALLY TWO-FOR-ONE TWISTING MACHINE OR DIRECT CABLING MACHINE

BACKGROUND OF THE INVENTION

The present invention relates to a spinning or twisting machine, especially a two-for-one twisting machine or direct cabling machine with two spindle rows arranged in the longitudinal direction of the machine frame. Two tangential drive belt arrangements for seperately driving the spindles of the first spindle row and the spindles of the second spindle row are provided. Each tangential drive belt arrangement is provided, in the area of the two machine ends, with pulleys fixedly connected to a shaft. Two drive motors are positioned at the opposite machine ends whereby each drive motor drives one of the two tangential drive belt arrangements.

Tangential drive belt arrangements have been known for a long time for use in connection with textile machines, especially twisting and spinning machines.

Spun yarns, twisted yarns and cabled yarns are produced in right-hand as well as left-hand twist (openband, respectively, crossband yarns). The right-hand twist is used especially for sewing threads in the staple fiber field and for special yarn constructions for carpet yarns. Approximately 90% of all twisting machines and cabling machines operate by left-hand twisting while the rest is operated by left-hand as well as right-hand twisting or only by right-hand twisting.

For reasons of flexibility, it is desirable to be able to adjust each machine at any time, if possible, without any complicated adjustment operations, to the manufacture of yarns or twines with left-hand or right-hand twist. Such a possibility is, in principle, provided with tangential drive belt arrangements or tambour drive arrangements. For both drive arrangements a reversal of rotational direction automatically results also in a force change from the pulling side of the drive belt to the idle side of the drive belt or, vice versa, from the idle (returning) side to the pulling side of the belt. For seperate belt drives at the two machine sides, the spindles (working units) are, of course, arranged only at one side of the drive belt. The second side of the drive belt is supported only by a minimal number of guide rollers.

When switching the machine operation from left-hand to right-hand twisting or vice versa, instable conditions would result in the aforementioned drive arrangement with respect to the drive moments acting on the spindles. This can only be compensated with an overly great pressing of the pressing rollers against the drive whorls and by providing additional guide rollers for the return (idle) side of the drive belt. These measures, however, are energy-intensive, technically complicated and thus expensive.

In German Patent 43 23 023 a two-for-one twisting machine with two parallel spindle rows, two tangential drive belt arrangements, and two drive motors at the opposite ends of the machine frame is disclosed. One of the drive motors is respectively used for driving one of the two tangential drive belts. When operation is switched from the manufacture of yarns with left-hand twist to the manufacture of yarns with a right-hand twist, whereby only the rotational direction of the drive motors and thus the running direction of the tangential drive belts is reversed, then, either for the right-hand or the left-hand operation, the respective returning (idle) side of the drive belt would drive the spindles. This, in addition to energy losses, would also require a complicated retrofitting of the pressing rollers. Furthermore, a correction of the belt tension would be required in order to compensate for an expansion within the pulling side of the belt (now without spindles).

In French patent 24 30 992 and in German patent application 33 01 811 twisting machines are disclosed in which at both machine sides a row of spindles is provided which are driven by a single tangential drive belt. At the two opposite machine ends a respective drive motor with reversal of rotational direction is provided. Thus, this arrangement allows to drive the tangential drive belt with opposite running direction for manufacturing yarns with left-hand twist as well as yarns with right-hand twist, whereby it is ensured at all times that the spindles of both spindle rows are driven by the pulling, i.e., the working side, of the tangential drive belt. However, in these two known machines it is not possible to operate each spindle row independently or separate from one another, for example, at different rpm, for the purpose of producing different types of yarns.

It is therefore an object of the present invention to embody a machine of the aforementioned kind, having two spindle rows extending parallel to one another in the longitudinal direction of the machine frame that can be driven independently or separate from one another, such that with constructively simple means it is made possible to use the machine optionally for manufacture of yarns or threads with left-hand twist or right-hand twist.

SUMMARY OF THE INVENTION

The inventive textile machine is primarily characterized by:

A machine frame having a first and a second end in a longitudinal direction;

Spindles connected to the machine frame in a first and a second row extending parallel in the longitudinal direction;

A first tangential drive belt arrangement for driving the spindles of the first row, comprising a first tangential drive belt and two first shafts, positioned at the first and second ends and having a first pulley connected thereto, the first tangential drive belt extending between the first and second ends and guided about the first pulleys;

A second tangential drive belt arrangement, for driving the spindles of the second row, comprising a second tangential drive belt and two second shafts, positioned at the first and second ends and having a second pulley connected thereto, the second tangential drive belt extending between the first and second ends and guided about the second pulleys;

A first drive motor positioned at the first end and a second drive motor positioned at the second end;

The first drive motor comprising a coupling device for engaging the first or the second tangential drive belt arrangement;

The second drive motor comprising a coupling device for engaging the first or second tangential drive belt arrangement not engaged by the first drive motor.

Advantagoeusly, each one of the first and second shafts has an auxiliary pulley. The coupling device of the first drive motor includes a drive belt placed onto the auxiliary pulley of the first or second shaft positioned at the first end. The coupling device of the second drive motor includes a drive belt placed onto the auxiliary pulley of the first or second shaft positioned at the second end.

Since, as desired, either one of the two drive motors can operate one or the other tangential drive belt arrangement, it is possible to drive the individual spindles with the working side of the tangential drive belt of the individual tangential drive belt arrangements in one or the other direction of rotation so that, as a function of the direction of rotation, the individual spindles can produce yarns or threads with right-hand or left-hand twist.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
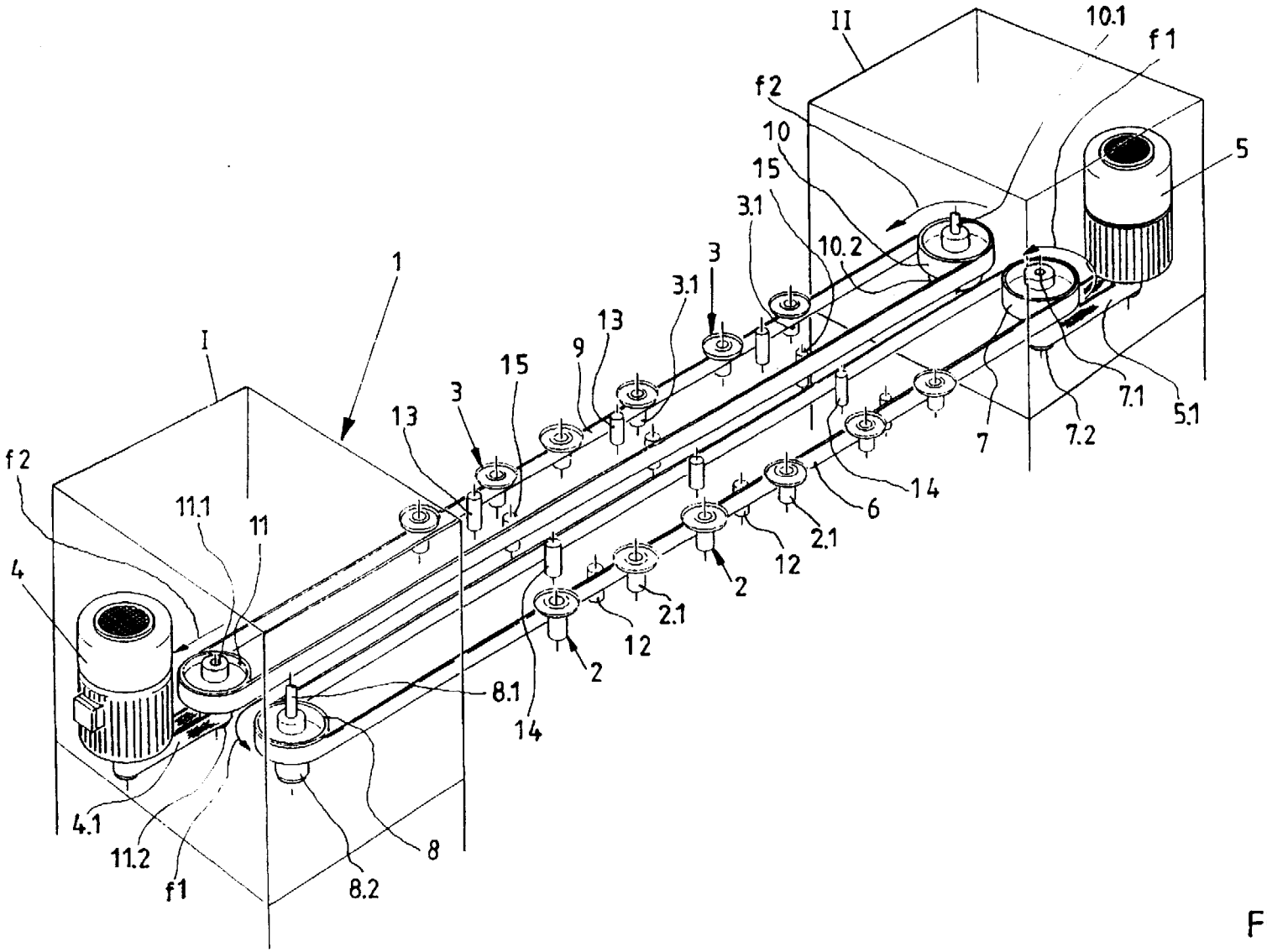
FIG. 1 shows a schematic representation of a spinning or twisting machine with a first drive arrangement for producing right-hand twisted yarns.

The present invention will now be described in detail with the aid of several specific embodiments utilizing FIGS. 1 and 2.

On a machine frame which is only schematically represented at 1, a first row of spindles 2 and a second row of spindles 3 are supported so that the spindles 2, 3 are rotatable. The individual spindles 2 and 3 are represented schematically only by their spindle whorls 2.1, 3.1.

In the area of the two machine frame ends I and II, a respective drive motor 4, 5 is shown, each of which is embodied as a motor with reversal of the rotational direction.

For driving the spindles 2 of the first spindle row, a tangential drive belt arrangement including tangential drive belt 6 is provided which in the area of the two machine frame ends I and II comprises pulleys 7 and 8 about which the drive belt 6 is guided. For driving the spindles 3 of the second spindle row, a tangential drive belt arrangement with tangential drive belt 9 and pulleys 10 and 11 about which the drive belt 9 is guided at the two machine frame ends I and II is provided.

Each pulley 7, 8, 10, 11 is rotationally fixedly connected to a respective shaft 7.1, 8.1, 10.1, 11.1. Each one of these shafts is provided with an auxiliary pulley 7.2, 8.2, 10.2, 11.2.

In the area of the respective working side of the drive belt 6 or 9, belt pressing rollers 12, 13 are provided, and, in the area of the idle side of the drive belt, conventional belt support rollers 14 and 15 are provided.

According to FIG. 1 the tangential drive belt 6 is driven by the motor 5 via a coupling device in the form of the drive belt 5.1 in the direction of arrows f1 in order to produce right-hand twisted yarn. With this arrangement the working side of the tangential drive belt 6 drives the spindles 2.

In a comparable manner, the drive belt 9 is driven by the motor 4 via a coupling device in the form of the drive belt 4.1 in the direction of arrow f2 so that again the working side of the tangential drive belt 9 drives the spindles 3.

Figure 2:
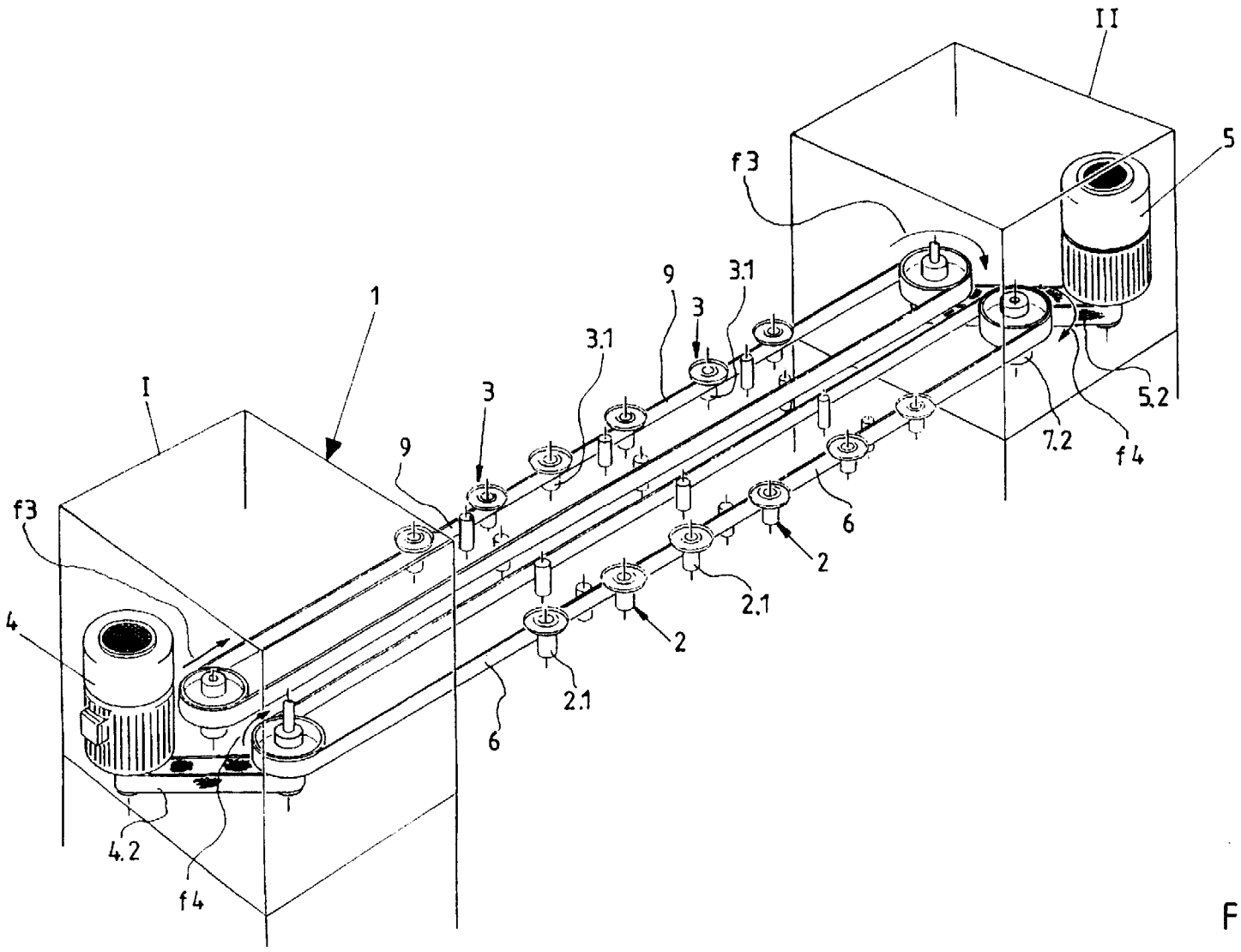
FIG. 2 shows the spinning or twisting device of FIG. 1 with a different drive arrangement for producing left-hand twisted yarns.

FIG. 2 shows the left-hand twist operation in which the motor 5 drives via drive belt 5.2 of the coupling device the tangential drive belt 9 in the direction of arrow f3. The motor 4 drives via the coupling device in the form of the drive belt 4.2 the tangential drive belt 6 in the direction of arrow f4. In both cases, the rotational direction of the motors 4 and 5 for a right-hand twist has been reversed relative to FIG. 1 so that, instead of a right-hand-twist, a left-hand twist is now produced. Thus, the respective working sides of the two tangential drive belts 6 and 9 now drive the spindles 2 and 3 in the so-called left-hand twist (FIG. 2).

The present invention is, of course, in no way restricted to the specific disclosure of the specification and drawings, but also encompasses any modifications within the scope of the appended claims.

What we claim is:

1. A textile machine comprising:

a machine frame having a first and a second end in a longitudinal direction;

spindles connected to said machine frame in a first and a second row extending parallel in said longitudinal direction;

a first tangential drive belt arrangement, for driving said spindles of said first row, comprising a first tangential drive belt and two first shafts, positioned at said first and second ends and having a first pulley connected thereto, said first tangential drive belt extending between said first and second ends and guided about said first pulleys;

a second tangential drive belt arrangement, for driving said spindles of said second row, comprising a second tangential drive belt and two second shafts, positioned at said first and second ends and having a second pulley connected thereto, said second tangential drive belt extending between said first and second ends and guided about said second pulleys;

a first drive motor positioned at said first end and a second drive motor positioned at said second end;

said first drive motor comprising a coupling device for engaging said first or second tangential drive belt arrangement;

said second drive motor comprising a coupling device for engaging said first or second tangential drive belt arrangement not engaged by said first drive motor.

2. A textile machine according to claim 1, wherein:

each one of said first and second shafts has an auxiliary pulley;

said coupling device of said first drive motor includes a drive belt placed onto said auxiliary pulley of said first shaft or said second shaft positioned at said first end;

said coupling device of said second drive motor includes a drive belt placed onto said auxiliary pulley of said first shaft or said second shaft positioned at said second end.

* * * * *